US007051387B1

(12) United States Patent
Yoder et al.

(10) Patent No.: US 7,051,387 B1
(45) Date of Patent: May 30, 2006

(54) BUTTON SLEEPING BAG

(76) Inventors: Carla J. Yoder, 3351 Granger Rd., Medina, OH (US) 44256; Scott M. Yoder, 3351 Granger Rd., Medina, OH (US) 44256

( * ) Notice: Subject to any disclaimer, the term of this patent is extended or adjusted under 35 U.S.C. 154(b) by 0 days.

(21) Appl. No.: 11/026,814

(22) Filed: Dec. 30, 2004

Related U.S. Application Data

(60) Provisional application No. 60/533,646, filed on Jan. 2, 2004.

(51) Int. Cl.
*A47G 9/08* (2006.01)

(52) U.S. Cl. ..... 5/413 R; 2/69.5

(58) Field of Classification Search ..... 5/413 R, 5/413 AM, 417, 419, 420; 2/69.5
See application file for complete search history.

(56) References Cited

U.S. PATENT DOCUMENTS 2,972,757 A * 2/1961 Adrian ..... 2/69.5
4,292,700 A * 10/1981 Markel ..... 5/413 R
4,413,368 A * 11/1983 Schuetze ..... 5/494
4,513,461 A * 4/1985 Tardivel ..... 5/413 R
4,601,076 A * 7/1986 Knobeloch ..... 5/413 R
4,774,734 A 10/1988 Mills
6,186,380 B1 2/2001 Grounds
6,367,083 B1 4/2002 November
6,463,604 B1 10/2002 Reveron et al.
6,598,248 B1 7/2003 Ong
6,799,339 B1 * 10/2004 Stewart ..... 5/413 AM
6,859,960 B1 * 3/2005 Jerome ..... 5/413 R
2003/0037373 A1 2/2003 Frazier
2003/0182724 A1 10/2003 Zheng
2003/0204908 A1 11/2003 Figler

* cited by examiner

*Primary Examiner*—Michael Trettel
(74) *Attorney, Agent, or Firm*—John D. Gugliotta; P. Jeff Martin

(57) ABSTRACT

A lightweight, portable, button sleeping bag having a plurality of removably-attachable independent fabric liners is provided. The sleeping bag includes article storage pockets. The sleeping bag is adapted to be quickly, easily, and efficiently folded, tightly rolled, and held for compact storage via resilient fasteners. The portable sleeping bag is ideally suited for home use, travel, and overnight visits with family and friends.

15 Claims, 6 Drawing Sheets

BUTTON SLEEPING BAG

RELATED APPLICATIONS

This application claims the benefit of U.S. Provisional Application No. 60/533,646 filed on Jan. 2, 2004.

BACKGROUND OF THE INVENTION

1. Field of the Invention

The present invention relates generally to an article of bedding and, more particularly, to a portable sleeping bag.

2. Description of the Related Art

Sleeping bags have become increasingly popular with children for overnight visits with family and friends, travel, camping, and even home use. However, preparing the child for a sleepover can be troublesome and inconvenient not only for the parent, but for the child as well. The parent bears the burden of collecting and packing necessary personal belongings and other necessary articles the child will minimally require. Typically, a separate cushion or pillow, pajamas, a favorite toy, and medication must be packed by the parent. This unnecessarily requires some items to be carried either by hand, or in a separate container, resulting most often in the assistance of a friend or parent to aid in carrying some of the items.

In addition, conventional sleeping bags are considerably heavy, bulky, and cumbersome, especially when carried by a child.

Furthermore, in order to provide for the most comfortable bedding arrangement, sleeping bags are often placed atop a conventional inflatable mattress. However, as one sleeps during the night, he often turns and experiences many sleep positions, thus causing the sleeping bag to be maneuvered away from support atop the inflatable mattress.

Moreover, conventional sleeping bags typically contain a closure system, such as a zipper, provided along the entire periphery of the bag. This commonly results in the excessive generation of body heat by the user when sleeping in such bag which can be remedied only by unzipping the bag and removing oneself therefrom. This further requires that the entire sleeping bag be washed once soiled, rather than washing or cleansing individual layers or linings thereof.

Accordingly, there exists a need for a lightweight, portable sleeping bag which is incorporated with article storage pockets, removably-attachable independent fabric liners, and a retainer means allowing such sleeping bag to be removably attached to a conventional inflatable mattress. The development of the portable, button sleeping bag fulfills this need.

A search of the prior art did not disclose any patents that read directly on the claims of the instant invention; however, the following references were considered related.

The following patents disclose bedding equipment of the sleeping bag type configured with various functional and amusement enhancements:

U.S. Pat. No. 4,774,734, issued in the name of Mills;

U.S. Pat. No. 6,367,083 B1, issued in the name of November;

U.S. Patent Application no. 2003/0037373 A1, filed in the name of Frazier,

U.S. Patent Application no. 2003/0182724 A1, filed in the name of Zheng; and

U.S. Patent Application no. 2003/0204908 A1, filed in the name of Figler.

U.S. Pat. No. 6,186,380 B1, issued in the name of Grounds discloses a combination sleeping pad and backpack which may be used as a sleeping pad that when assembled and fastened together, portions of the pad function as a backpack.

U.S. Pat. No. 6,598,248 B1, issued in the name of Ong discloses an article of bedding designed and configured so as to be utilized as a cover and also converted to a toss pillow, wherein toss pillow is equipped with its own self-contained storage envelope.

U.S. Pat. No. 6,463,604 B1, issued in the name of Reveron et al. discloses an apparatus for securely packaging and transporting one's personal items and bedding material when arranged in a compact, mobile configuration, and also providing bedding material and packaging compartments for holding personal items.

Consequently, a need has been felt for a lightweight, portable sleeping bag which is incorporated with article storage pockets, removably-attachable independent fabric liners, and a retainer means allowing such sleeping bag to be removably attached to a conventional inflatable mattress in a manner which is quick, easy, and efficient.

SUMMARY OF THE INVENTION

Therefore, it is an object of the present invention to provide a lightweight, portable sleeping bag having a plurality of removably-attachable independent fabric liners.

It is another object of the present invention to provide a portable sleeping bag which includes article storage pockets.

It is another object of the present invention to provide a portable steeping bag adapted to be quickly, easily, and efficiently folded and rolled into compact storage.

It is another object of the present invention to provide a portable sleeping bag which includes resilient fasteners which function to hold the sleeping bag in a tightly rolled, compact configuration.

It is another object of the present invention to provide a portable sleeping bag which includes an elastic retainer means for removably attaching the present invention to a standard inflatable mattress.

It is another object of the present invention to provide an independent pillow for placement at the head rest portion of the portable sleeping bag.

It is another object of the present invention to provide fabric liners adorned in various ornamental designs and shades.

Briefly described according to one embodiment of the present invention, a portable, button sleeping bag is provided. The portable, button sleeping bag is ideally suited for home use, travel, and for overnight visits with family and friends. The portable, button sleeping bag is quickly, easily, and efficiently folded and rolled into compact storage.

The portable, button sleeping bag comprises an outer lining and a lower lining having a pair of inner linings positioned therebetween which form a four-layered structure defining an elongated, rectangular configuration. While the present invention is described as having four linings, it is understood and anticipated that any number of linings may be utilized, hence the number of linings described herein is not intended to be a limiting factor. The outer lining is further described as being reversible.

The four-layered structure further defines an anterior portion opposing a posterior portion. The anterior portion includes a head rest portion, while the posterior portion provides a foot rest portion. An independent pillow is provided for placement at the head rest portion.

The outer lining and lower lining are fabricated of an insulating fabric material which provides warmth and comfort to the user. The inner linings are fabricated of a lightweight fabric material, which includes but is not limited to linen and cotton.

The outer, inner, and lower linings are removably connected in an independent manner via selectively-operable releasable fasteners. The selectively-operable releasable fasteners provide user with the option of varying the number of linings utilized, hence, varying the degree of warmth according to user preference.

The selectively-operable releasable fasteners are adapted to conjunctively join edges of the linings along a periphery thereof in an enclosed manner, excluding the head rest portion, or in a partially enclosed manner at selectively-desired, random sections along the periphery. The releasable fasteners are shown herein as enlarged buttons sewn along a periphery of the lower lining.

The outer lining, inner linings, and lower lining are each provided with plackets specifically aligned and spaced to facilitate engageable connection with buttons. A plurality of enlarged buttons are further provided atop the outer layer, being sewn thereto in a linear pattern which traverses the outer layer generally along a midportion thereof.

A plurality of pockets are sewn along an upper surface of the lower lining near a top portion thereof, wherein such pockets are adjacently positioned relative to one another. A plurality of pockets are also sewn along an upper surface and lower surface of the outer lining near a bottom portion thereof, wherein such pockets are adjacently positioned relative to one another. The addition of pockets along both surfaces of outer lining facilitate reversibility of outer lining. The plurality of pockets provide compartments for holding personal belongings and the like.

In order to utilize the present invention with a conventional inflatable mattress, the portable sleeping bag is adapted with an elastic retainer means being fastened to an underside of the lower lining. The elastic retainer means is adapted to fit-over and conform around corners or edges of a conventional inflatable mattress.

In order to facilitate transport of the portable sleeping bag and to retain for safe keeping personal belongings, independent pillow, and fabric linings, a plurality of elastic, releasable fasteners are provided. The elastic, releasable fasteners function to hold the portable sleeping bag in a rolled-up configuration. The plurality of elastic, releasable fasteners are attached along an upper edge of both the outer and lower lining. A plurality of elastic, releasable fasteners are further attached atop the outer layer, in a linear pattern traversing the outer layer, parallel to and above enlarged buttons proximally located therewith. The plurality of elastic, releasable fasteners are adapted to engageably connect to buttons sewn along the upper surface of the outer lining, thus allowing the portable sleeping bag to be conveniently transported in a compact condition without danger of linings becoming unfolded and the escape of personal belongings and pillow.

It is envisioned that the fabric linings are adorned in various ornamental designs and shades.

It is further envisioned that the present invention is available as a single or a double sleeper article.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
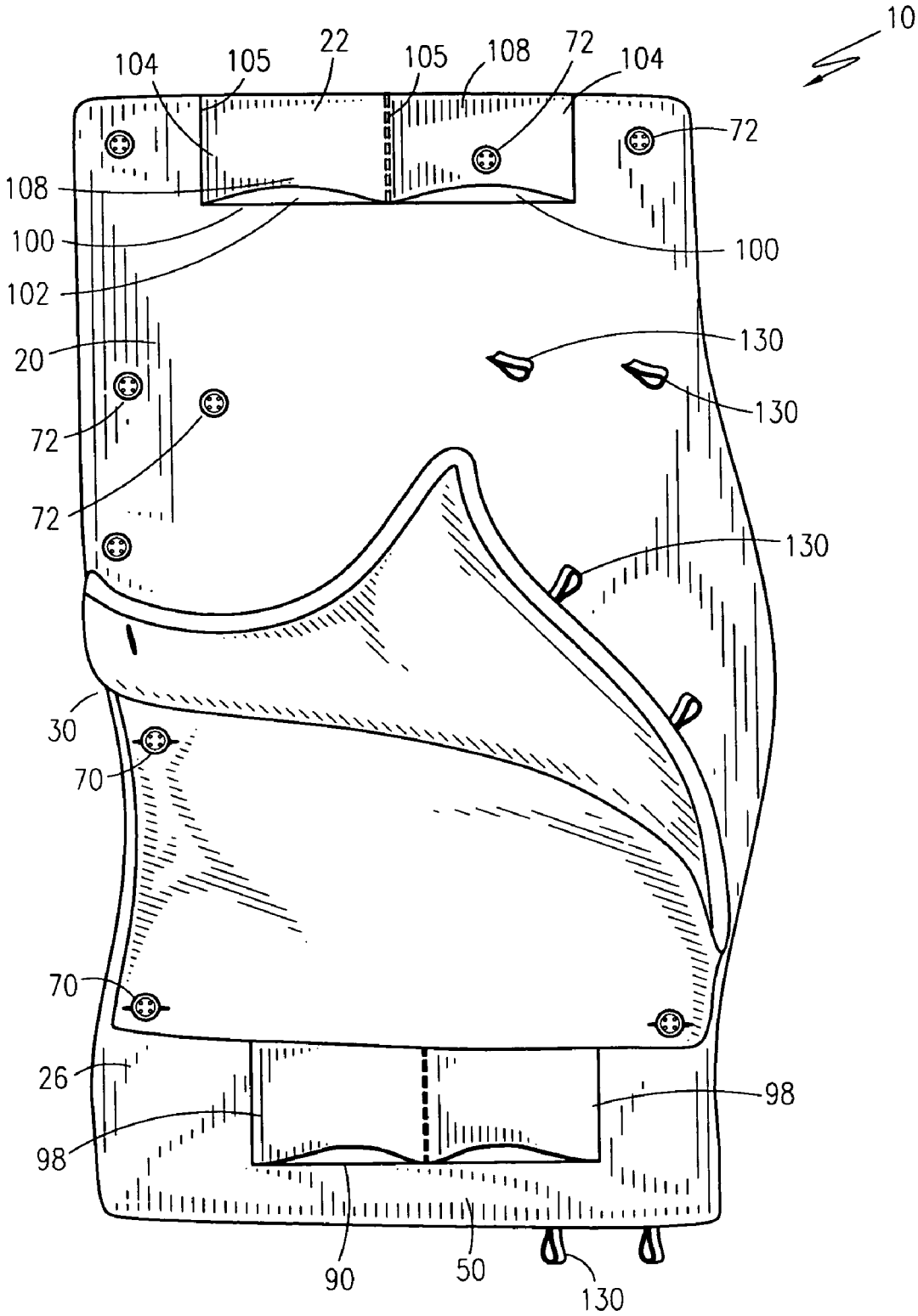
FIG. 1 is a perspective view of a portable, button sleeping bag, according to the preferred embodiment of the present invention.

Referring now to FIGS. 1–4, and 7, a portable, button sleeping bag 10 is provided, according to the present invention, being ideally suited for home use, travel, and for overnight visits with family and friends. The portable, button sleeping bag 10, hereinafter sleeping bag 10, is quickly, easily, and efficiently folded and rolled into compact storage.

The sleeping bag 10 comprises an outer lining 20 and a lower lining 26 having a pair of inner linings 30 positioned therebetween which form a four-layered structure 40 defining an elongated, rectangular configuration. While the present invention is described as having four linings, it is understood and anticipated that any number of linings may be utilized, hence the number of linings described herein is not intended to be a limiting factor.

The outer lining 20 and lower lining 26 each defines an anterior portion 21, 27 opposing a posterior portion 22, 28, respectively. The anterior portion 27 of lower lining 26 includes a head rest portion 50, while the posterior portion 28 provides a foot rest portion 52. The outer lining 20 is further defined as being reversible in that outer lining 20 has an upper surface 20*a* and a lower surface 20*b* being equally usable in that a plurality of auxiliary pockets 100 is formed along both surfaces 20*a*, 20*b* of outer lining 20 which advances outer lining's 20 reversible design (to be described in greater detail below). An independent pillow 60 is provided for placement about the head rest portion 50. The pillow 60 is covered with a covering fabricated of a lightweight fabric material which corresponds to the fabric material also utilized for fabricating the pair of inner linings 30.

The outer lining 20 and lower lining 26 are each defined of an elongated, rectangular configuration. The outer lining 20 and lower lining 26 are preferably fabricated of an insulating fabric material which provides warmth and comfort to the user. However, it is envisioned that outer lining 20 and lower lining 26 may also be fabricated of a textile or synthetic material adapted to repel water and moisture. The pair of inner linings 30 comprise a first lining 32 and a second lining 33. The first lining 32 and second lining 33 are each defined of an elongated, rectangular configuration, and are fabricated of a lightweight fabric material, which includes but is not limited to linen, cotton, and fleece. The first lining 32 and second lining 33 are adapted to be enclosed in a connected manner between the outer lining 20 and the lower lining 26.

The outer lining 20, the first lining 32, the second lining 33, and the lower lining 26 are removably connected in an independent manner via a plurality of selectively-operable, releasable fasteners 70. The selectively-operable, releasable fasteners 70 provide user with the option of varying the number of linings utilized, hence, varying the degree of warmth according to user preference. In addition, because linings 20, 32, 33, 26 can be easily and quickly connected and disconnected in an independent manner, the linings 20, 32, 33, 26 can be separately or conjunctively washed as desired, thus facilitating enhanced personal hygiene.

The selectively-operable, releasable fasteners 70 are adapted to conjunctively join edges of the outer lining 20, the first lining 32, the second lining 33, and the lower lining 26 along a periphery thereof in an enclosed manner, excluding the head rest portion 50, or conjunctively join edges of the outer lining 20, the first lining 32, the second lining 33, and the lower lining 26 in a partially enclosed manner at selectively-desired, random sections along the periphery of each lining 20, 32, 33, 26. The releasable fasteners 70 are shown herein as enlarged buttons 72 sewn along a periphery of the lower lining 26.

The outer lining 20, the first lining 32, the second lining 33, and lower lining 26 are each provided with plackets 80 specifically aligned and spaced to facilitate engageable connection with buttons 72. A plurality of enlarged buttons 72 are also sewn atop the outer lining 20 in a linear pattern which traverses the outer lining 20 generally along a mid-portion thereof, as shown in FIG. 1.

A plurality of pockets 90 are sewn along an upper surface 29 of the lower lining 26 near the anterior portion 27 thereof, wherein such pockets 90 are adjacently positioned relative to one another. Each pocket 90 includes an insert opening 92 formed from a sheath 94 of fabric sewn via stitching 95 to the upper surface 29 of lower lining 26 in such a manner so as to form an article storage compartment 98, within which various articles such as personal belongings, clothing, and toys may be stored.

A plurality of auxiliary pockets 100 are sewn along an upper surface 20*a* and lower surface 20*b* of the outer lining 20 near the posterior portion 22 thereof, wherein auxiliary pockets 100 are adjacently positioned relative to one another. Each auxiliary pocket 100 includes an insert opening 102 formed from a sheath 104 of fabric sewn via stitching 105 to the upper surface 20*a* and lower surface 20*b* of outer lining 20 in such a manner so as to form an article storage compartment 108, within which various articles such as personal belongings, clothing, and toys may be stored.

It is envisioned that insert opening 92, 102 can be securably closed via a closure means 150 such as a hook and loop fastener 152.

Figure 5:
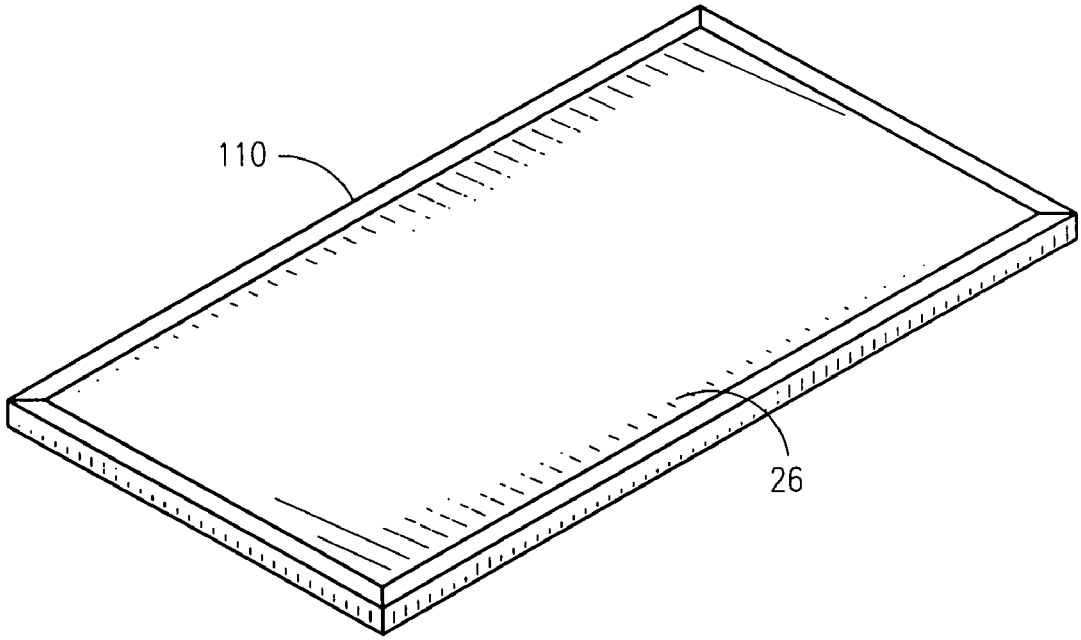
FIG. 5 illustrates an alternate embodiment of the present invention shown adapted with an elastic retainer means.
Figure 6:
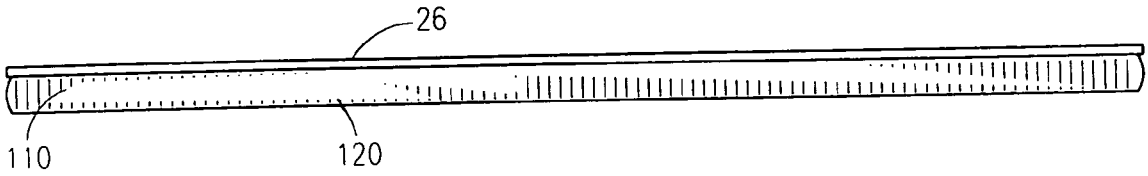
FIG. 6 is a side elevational view of the alternate embodiment shown attached to a standard inflatable mattress.

Referring now to FIGS. 5 and 6, in order to utilize the present invention with a standard inflatable mattress, an alternate embodiment of the portable, button sleeping bag 10 is provided, wherein sleeping bag 10 is adapted with an elastic retainer means 110 being suitably fastened to an underside of the lower lining 26 about a periphery thereof. The elastic retainer means 110 is adapted to fit-over and conform tightly around corners or edges of a standard inflatable mattress 120.

Figure 2:
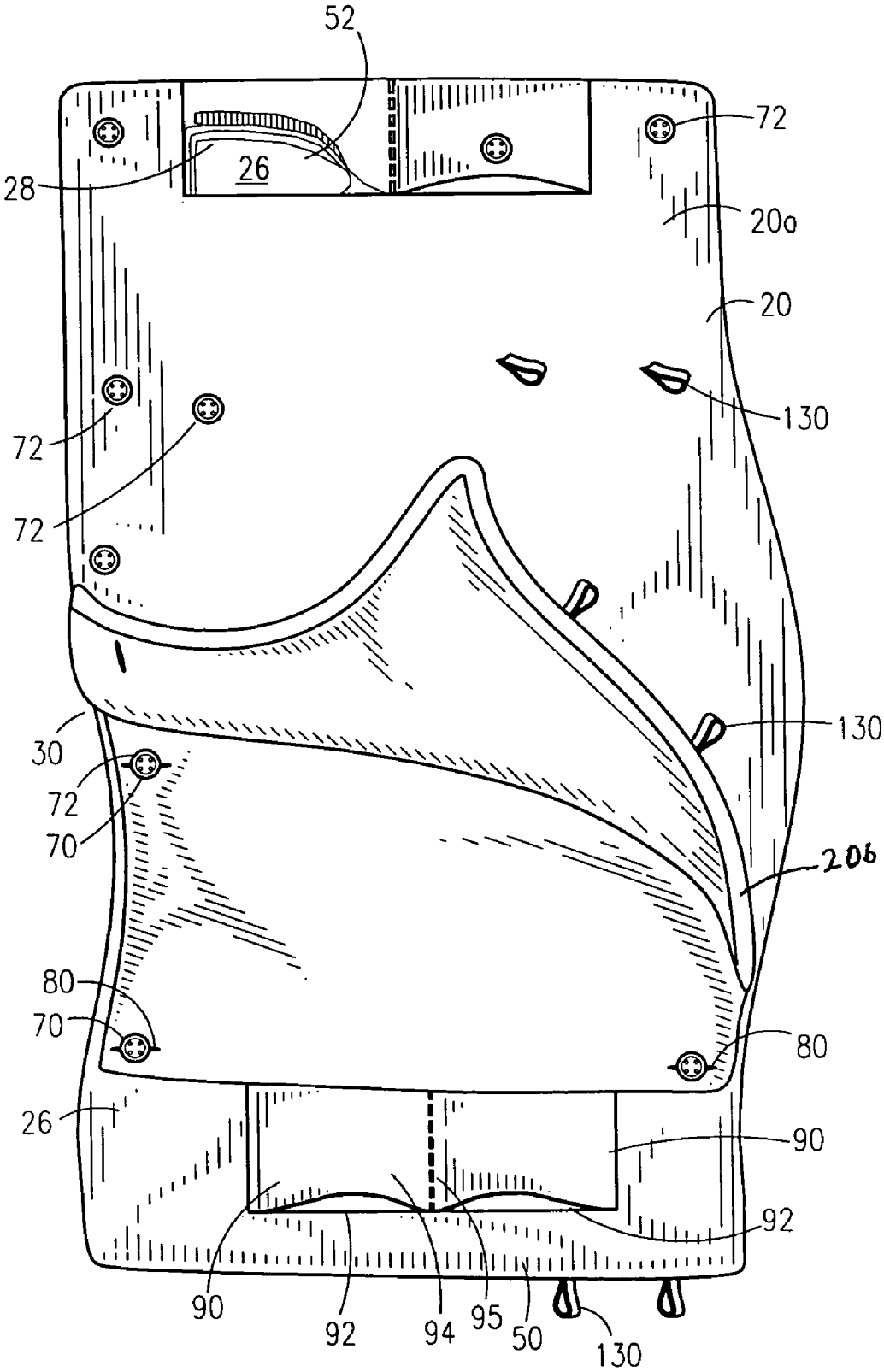
FIG. 2 is a perspective cutaway view of the portable, button sleeping bag illustrating the foot rest portion of the lower lining located at the posterior portion thereof, according to the preferred embodiment.
Figure 3:
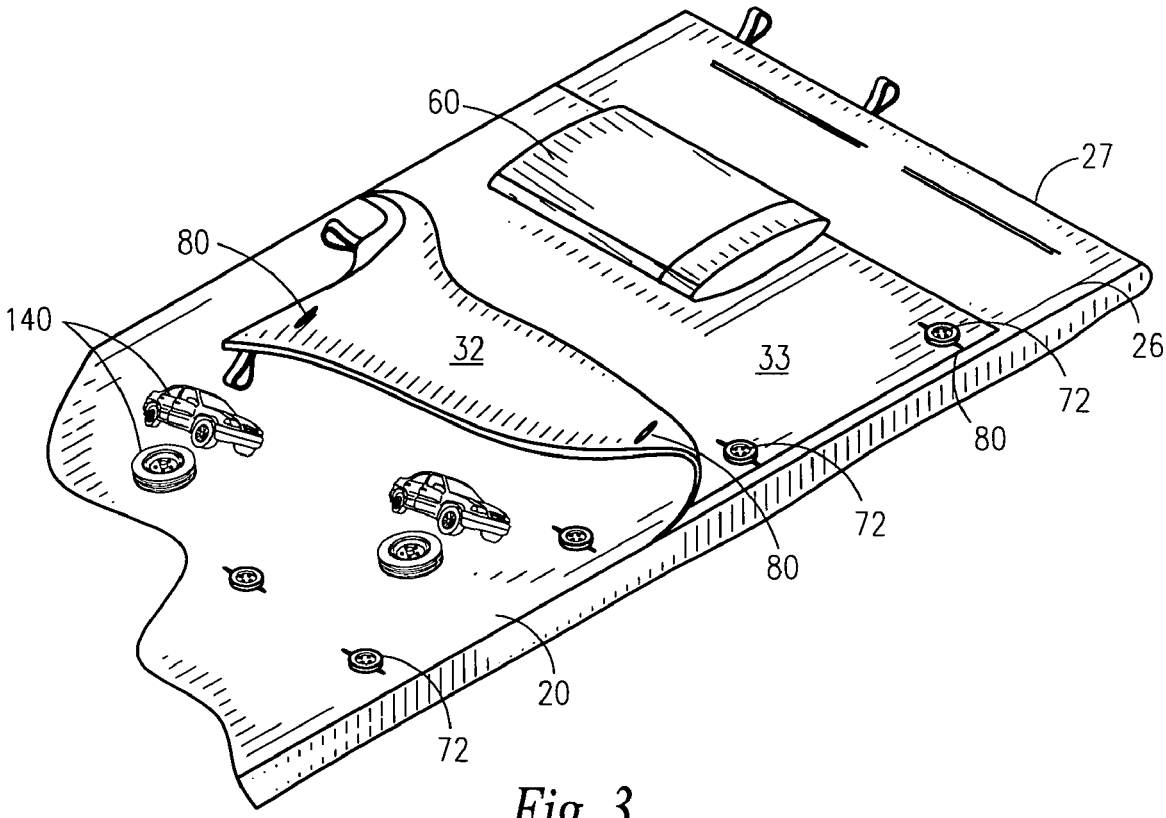
FIG. 3 is a top side view of the present invention, according to the preferred embodiment.
Figure 4:
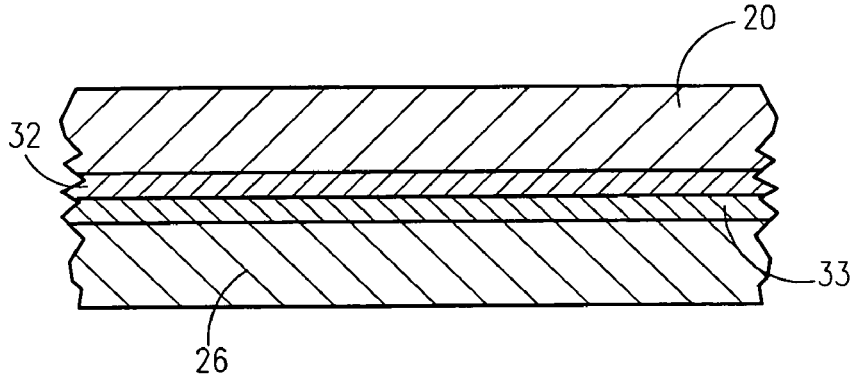
FIG. 4 is a cross-sectional view of the portable, button sleeping bag illustrating the four-layered structure, according to the preferred embodiment.
Figure 7:
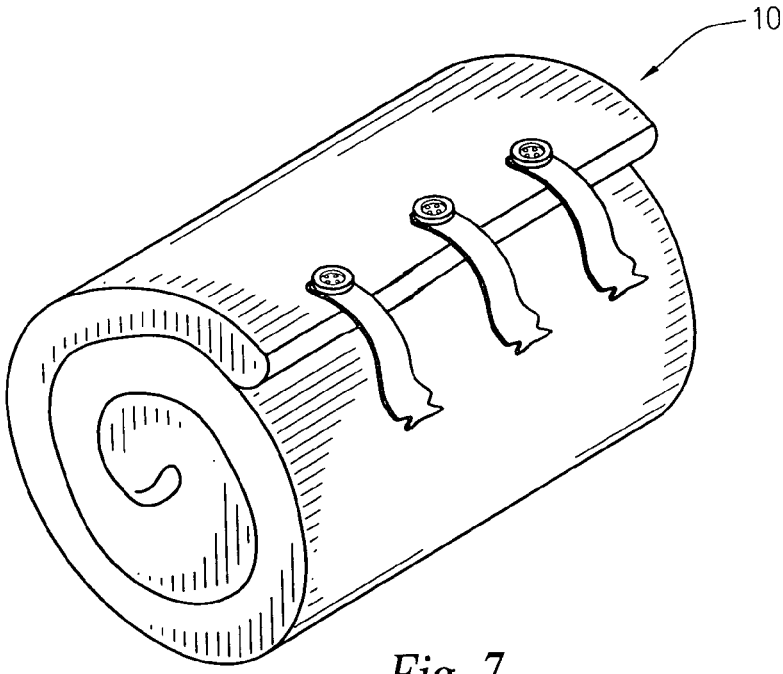
FIG. 7 is a perspective view of the present invention according to the preferred embodiment thereof, shown neatly rolled for compact storage or transport.

Referring now to FIGS. 1–3, and more specifically to FIG. 7, in order to facilitate transport of the sleeping bag 10 and to retain for the safe keeping of personal belongings, independent pillow 60, and pair of inner linings 30, a plurality of resilient fasteners 130 are provided. The resilient fasteners 130 function to hold the sleeping bag 10 in a tightly rolled, compact configuration. The plurality of resilient fasteners 130 are formed of an elastic material. The plurality of resilient fasteners 130 are attached along the anterior portion 21, 27 of both the outer lining 20 and lower lining 26, respectively. A plurality of resilient fasteners 130 are further attached atop the outer lining 20, in a linear pattern traversing the outer lining 20, parallel to and above enlarged buttons 72 proximally located therewith. The plurality of resilient fasteners are adapted to engageably connect to buttons 72 sewn along the upper surface 20*a* of outer lining 20, thus allowing the sleeping bag 10 to be conveniently transported in a compact, rolled condition without danger of linings 20, 26, 32, 33 becoming unfolded and the escape of personal belongings and pillow 60.

It is envisioned that the outer lining 20, the first lining 32, the second lining 33, and lower lining 26 are adorned in various ornamental patterns, designs and shades 140, as shown in FIG. 3.

Figure 8:
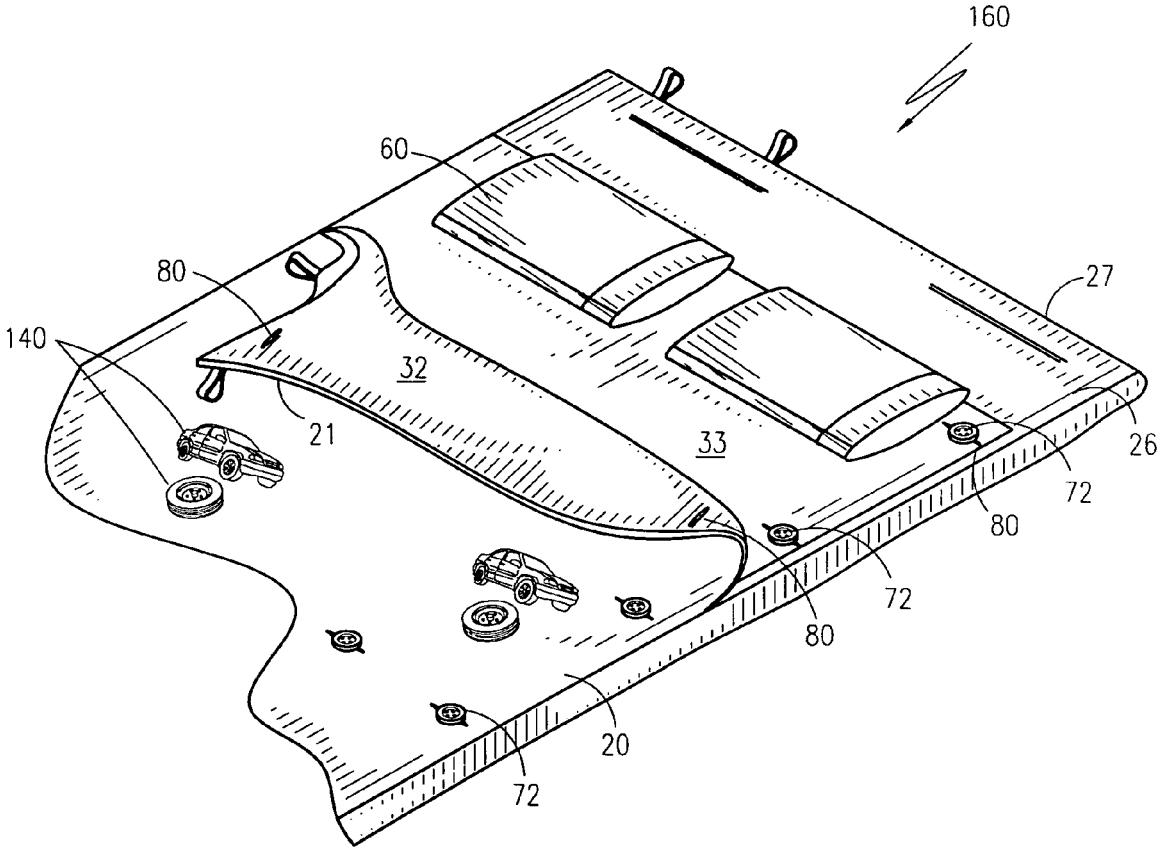
FIG. 8 is a perspective view of the present invention shown as a double sleeper article.

It is further envisioned that the present invention is available as a single article as shown in FIGS. 1–7, or a double sleeper article 160 as shown in FIG. 8.

2. Operation of the Preferred Embodiment

To use the present invention, user selects the desired number of linings according to need. In the event user elects to utilize the pair of inner linings 30, the linings 30 are positioned and interconnected between the outer lining 20 and the lower lining 26. Through the use of releasable fasteners 70 or enlarged buttons 72, user conjunctively joins edges of the outer lining 20, the first lining 32, the second lining 33, and the lower lining 26 along a periphery thereof in an enclosed manner, excluding the head rest portion 50. User places the independent pillow 60 at the head rest portion 50 of the portable, button sleeping bag 10. After use, user folds and tightly rolls the sleeping bag 10. Finally, user connects the resilient fasteners 130 to the enlarged buttons 72 located along the upper surface 20*a* of outer lining 20, thereby permitting the sleeping bag 10 to be conveniently transported in a compact, rolled condition without danger of linings 20, 26, 32, 33 becoming unfolded and the escape of personal belongings and pillow 60.

The use of the present invention provides user with a lightweight, portable sleeping bag which is incorporated with article storage pockets, removably-attachable independent fabric liners, and a retainer means allowing such sleeping bag to be removably attached to a conventional inflatable mattress.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A portable sleeping bag comprising:

an outer lining;

a lower lining;

a plurality of inner linings positioned between said outer lining and said lower lining so as to form a multi-layered structure defining an elongated, rectangular configuration, wherein said plurality of inner linings comprise a first lining and a second lining, said first lining and said second lining are each defined of an elongated, rectangular configuration, wherein said first lining and said second lining are adapted to be enclosed in a connected manner between said outer lining and said lower lining;

wherein said outer lining, said first lining said second lining, and said lower lining are removably connected in an independent manner via said plurality of releasable fasteners, said releasable fasteners provide user with an option of varying a number of linings utilized, hence, varying a degree of warmth according to user preference;

a plurality of releasable fasteners, said plurality of releasable fasteners are adapted to removably connect said outer lining, said plurality of inner linings and said lower lining in an independent manner, said plurality of releasable fasteners provide user with option of varying a number of linings utilized, hence, varying a degree of warmth according to user preference wherein said releasable fasteners are defined as enlarged buttons sewn along a periphery of said lower lining, said enlarged buttons are also sewn atop said outer lining in a linear pattern which traverses said outer lining generally along a midportion of said outer lining.

2. The portable sleeping bag of claim 1, further comprising an elastic retainer means suitably fastened to an underside of said lower lining about a periphery of said lower lining, said elastic retainer means is adapted to fit-over and conform tightly around corners or edges of a standard inflatable mattress, thereby adapting said portable sleeping bag for use with the standard inflatable mattress.

3. The portable sleeping bag of claim 1, further comprising a plurality of resilient fasteners, said plurality of resilient fasteners function to hold said portable sleeping bag in a tightly rolled, compact configuration.

4. The portable sleeping bag of claim 3, wherein said plurality of resilient fasteners are formed of an elastic material.

5. The portable sleeping bag of claim 4, wherein said plurality of resilient fasteners are attached along said anterior portion of both said outer lining and said lower lining, said plurality of resilient fasteners are also attached atop said outer lining in a linear pattern traversing said outer lining, parallel to and above enlarged buttons being proximally located to said plurality of resilient fasteners, said plurality of resilient fasteners are adapted to engageably connect to said enlarged buttons sewn along said upper surface of said outer lining, thus allowing said portable sleeping bag to be conveniently transported in a compact, rolled condition without danger of said outer lining, said lower lining, and said plurality of inner linings becoming unfolded and escape of personal belongings.

6. The portable sleeping bag of claim 1, wherein said outer lining and said lower lining are each fabricated of an insulating fabric material.

7. The portable sleeping bag of claim 1, wherein said outer lining and said lower lining are each fabricated of a textile or synthetic material adapted to repel water and moisture.

8. The portable sleeping bag of claim 1, wherein said plurality of inner linings are fabricated of a lightweight fabric material.

9. The portable sleeping bag of claim 1, wherein said outer lining, said plurality of inner linings, and said lower lining are each adorned in various ornamental patterns, designs and shades.

10. The portable sleeping bag of claim 1, further comprising an independent pillow adapted for placement about said head rest portion of said anterior portion of said lower lining.

11. The portable sleeping bag of claim 1, wherein said outer lining and lower lining are each defined of an elongated, rectangular configuration.

12. The portable sleeping bag of claim 1, wherein said releasable fasteners are adapted to conjunctively join edges of said outer lining, said first lining, said second lining, and said lower lining along a periphery thereof in an enclosed manner, excluding said head rest portion, or conjunctively join edges of said outer lining, said first lining, said second lining, and said lower lining in a partially enclosed manner at selectively-desired, random sections along the periphery of said outer lining, said first lining, said second lining, and said lower lining.

13. A portable sleeping bag comprising:

an outer lining;

a lower lining;

a plurality of inner linings positioned between said outer lining and said lower lining so as to form a multi-layered structure defining an elongated, rectangular configuration, wherein said plurality of inner linings comprise a first lining and a second lining, said first lining and said second lining are each defined of an elongated, rectangular configuration, wherein said first lining and said second lining are adapted to be enclosed in a connected manner between said outer lining and said lower lining;

wherein said outer lining, said first lining, said second lining, and said lower lining are removably connected in an independent manner via a plurality of releasable fasteners, said releasable fasteners provide user with an option of varying a number of linings utilized, hence varying a degree of warmth according to user preference;

a plurality of releasable fasteners, said plurality of releasable fasteners are adapted to removably connect said outer lining, said plurality of inner linings and said lower lining in an independent manner, said plurality of releasable fasteners provide user with option of varying a number of linings utilized, hence varying a degree of warmth according to user preference, said releasable fasteners are defined as enlarged buttons sewn along a periphery of said lower lining, said enlarged buttons are also sewn atop said outer lining in a linear pattern which traverses said outer lining generally along a midpoint of said outer lining;

wherein said outer lining, said first lining, said second lining, and said lower lining are each provided with plackets specifically aligned and spaced to facilitate engageable connection with said enlarged buttons.

14. A portable sleeping bag comprising:

an outer lining;

a lower lining, wherein said outer lining and said lower lining each defines an anterior portion opposing a posterior portion, said anterior portion of said lower lining includes a head rest portion, while said posterior portion of said lower lining provides a foot rest portion, and wherein said outer lining is reversible;

a plurality of inner linings positioned between said outer lining and said lower lining so as to form a multi-layered structure defining an elongated, rectangular configuration, wherein said plurality of inner linings comprise a first lining and a second lining, said first lining and said second lining are each defined of an elongated, rectangular configuration, wherein said first lining and said second lining are adapted to be enclosed in a connected manner between said outer lining and said lower lining;

wherein said outer lining, said first lining, said second lining, and said lower lining are removably connected in an independent manner via said plurality of releasable fasteners, said releasable fasteners provide user with an option of varying a number of linings utilized, hence, varying a degree of warmth according to user preference;

a plurality of releasable fasteners, said plurality of releasable fasteners are adapted to removably connect said outer lining, said plurality of inner linings and said lower lining in an independent manner, said plurality of releasable fasteners provide user with option of varying a number of linings utilized, hence, varying a degree of warmth according to user preference;

wherein said lower lining includes a plurality of pockets sewn along an upper surface of said lower lining near said anterior portion thereof, wherein said plurality of pockets are adjacently positioned relative to one another, and wherein each of said plurality of pockets includes an insert opening formed from a sheath of fabric sewn via stitching to said upper surface of said lower lining in such a manner so as to form an article storage compartment, within which various articles are stored.

15. A portable sleeping bag comprising:

an outer lining;

a lower lining, wherein said outer lining and said lower lining each defines an anterior portion opposing a posterior portion, said anterior portion of said lower lining includes a head rest portion, while said posterior portion of said lower lining provides a foot rest portion, and wherein said outer lining is reversible;

a plurality of inner linings positioned between said outer lining and said lower lining so as to form a multi-layered structure defining an elongated, rectangular configuration, wherein said plurality of inner linings comprise a first lining and a second lining, said first lining and said second lining are each defined of an elongated, rectangular configuration, wherein said first lining and said second lining are adapted to be enclosed in a connected manner between said outer lining and said lower lining;

wherein said outer lining, said first lining, said second lining, and said lower lining are removably connected in an independent manner via said plurality of releasable fasteners, said releasable fasteners provide user with an option of varying a number of linings utilized, hence, varying a degree of warmth according to user preference;

a plurality of releasable fasteners, said plurality of releasable fasteners are adapted to removably connect said outer lining, said plurality of inner linings and said lower lining in an independent manner, said plurality of releasable fasteners provide user with option of varying a number of linings utilized, hence, varying a degree of warmth according to user preference;

wherein said outer lining includes a plurality of auxiliary pockets sewn along an upper surface of said outer lining near said posterior portion thereof, wherein auxiliary pockets are adjacently positioned relative to one another, and wherein each of said plurality of auxiliary pockets includes an insert opening formed from a sheath of fabric sewn via stitching to said upper surface of said outer lining in such a manner so as to form an article storage compartment, within which various articles are stored.

* * * * *